US006715395B1

(12) United States Patent
Heibel

(10) Patent No.: US 6,715,395 B1
(45) Date of Patent: Apr. 6, 2004

(54) METHOD AND APPARATUS FOR DISABLING A PURSUED VEHICLE

(76) Inventor: Thomas S. Heibel, 4020 S. Elati St., Englewood, CO (US) 80110

( * ) Notice: Subject to any disclaimer, the term of this patent is extended or adjusted under 35 U.S.C. 154(b) by 0 days.

(21) Appl. No.: 10/248,346

(22) Filed: Jan. 10, 2003

(51) Int. Cl.[7] ..... F41F 5/00
(52) U.S. Cl. ..... 89/1.11; 180/287
(58) Field of Search ..... 89/1.1, 1.11; 180/287; 404/6

(56) References Cited

U.S. PATENT DOCUMENTS

| | | | | |
|---|---|---|---|---|
| 3,661,115 A | * | 5/1972 | Rosenstein | |
| 5,611,408 A | * | 3/1997 | Abukhader | 180/287 |
| 5,839,849 A | * | 11/1998 | Pacholok et al. | 404/6 |
| 6,295,753 B1 | | 10/2001 | Thummel | 42/116 |
| 6,295,754 B1 | | 10/2001 | Otteman et al. | 42/124 |
| 6,338,218 B1 | | 1/2002 | Hegler | 42/94 |
| 6,374,525 B1 | | 4/2002 | Thomas | 42/51 |
| 6,527,475 B1 | * | 3/2003 | Lowrie | 404/6 |

FOREIGN PATENT DOCUMENTS

| | | | | |
|---|---|---|---|---|
| FR | 1.122.914 | * | 6/1956 | 89/1.11 |

* cited by examiner

*Primary Examiner*—Stephen M. Johnson
(74) *Attorney, Agent, or Firm*—Kyle W. Rost

(57) ABSTRACT

A pursuit vehicle carries a remote targeting device in a suitable position to identify a target area on an inflated tire of the pursued vehicle and a launcher for a projectile suited to puncture an inflated tire of a pursued vehicle, from a position trailing the pursued vehicle. The projectile launcher launches the projectile when suitably triggered. An electrically operated, remote triggering device selectively causes the projectile launcher to launch the projectile at the identified target area, puncturing and thereby disabling the tire of the pursued vehicle.

16 Claims, 8 Drawing Sheets

METHOD AND APPARATUS FOR DISABLING A PURSUED VEHICLE

BACKGROUND OF INVENTION

1. Field of the Invention

The invention generally relates to firearms and to an apparatus and method for using a firearm to stop a fleeing terrorist, criminal or other suspect. In another aspect, the invention relates to illumination with an implement holder such as a firearm. More specifically, an illumination device and firearm are held within a container for secure mounting to a vehicle.

2. Description of Related Art

Including Information Disclosed Under 37 CFR 1.97 and 1.98—Small caliber firearms tend to be hand held, such as pistols or rifles. Aiming a hand held firearm is a matter of individual skill. Sometimes the shooter will sight along a barrel to approximate a point where the shot will land. Sighting aids commonly include telescopes mounted to the firearm and adjusted by trial and error to align with path of the shot as perfectly as the shooter can determine. Adjustable mounting devices allow the telescope to adjusted in two axes, generally termed elevation and windage. Such adjustments allow the telescope to be pre-sighted to the likely path of a fired bullet. In addition, the shooter has the option to modify the settings to account for ambient conditions, such as to compensate for a cross-wind or to compensate for an unusually long or short intended length of the shot.

A much improved sighting aid is the laser scope, which is mounted to the firearm and aimed much like a telescope. However, the shooter need not hold the firearm at eye level. A laser light beam projects along the path onto the target and can be viewed while the firearm is held in any desired position.

Small caliber firearms have departed from being hand held for many special purposes. For military use in the early days of aviation, firearms became mounted to aircraft in a fixed position, so that the pilot could aim only by pointing the aircraft directly at the target. Remote firing mechanisms were devised to work in combination with the continuing need to fly the aircraft. Thus, a remote switch was conveniently mounted on the flight controls to fire the aircraft's weapons through suitable electrical or mechanical means.

A variety of recent patent art shows many improvements in the aiming and remote firing of small caliber firearms. U.S. Pat. No. 6,374,525 to Thomas discloses an electronically switched ignition system that, while still fired by a mechanically pulled trigger, easily could be adapted for remote firing by sending an electrical signal. U.S. Pat. No. 6,295,754 to Otteman et al. shows an aiming device for a telescopic sight. The substitution of a laser scope for a telescopic sight would allow equally beneficial aiming of the laser beam. U.S. Pat. No. 6,295,753 to Thummel shows a laser precision bore sight assembly, in which a laser device is mounted on the forward end of an elongated guide that is inserted down the front end of a firearm barrel. Guided and aimed by the barrel itself, the laser beam shows where the firearm is aimed with high precision. This type of aiming device appears useful when a firearm is mounted in a fixed position, such as to a bench vise, and would provide a way to align a scope to a firearm without the necessity of firing the firearm. Mounting devices for firearms often are used, which include not only bench vices but other shooting supports. U.S. Pat. No. 6,338,218 to Hegler shows a supporting device that allows the firearm to be finely aligned for aiming.

Thus, firearms can be mounted to a fixed base and given a predetermined alignment with respect to such base for aiming purposes. Sights such as laser scopes can be mounted to a firearm or in association with a firearm and adjusted to project the laser beam at a predetermined target location. However, despite these known abilities, one area stands out as needing practical improvement.

Police and other security agencies are called upon to capture suspected criminals. High speed automobile chases are known to result. While police may be well-trained in driving skills for conducting such chases, unexpected and accidental events can occur. The suspect may exceed his own driving skills and crash his car. Bystanders in cars or on foot are at risk of injury from any of the participants in the chase. On occasion, police and the fleeing suspect exchange gun fire, creating further risk of accidental injury to bystanders. It is clearly in the public interest that chases of this type be terminated quickly and with minimum danger to bystanders. Further, with increasing concerns over possible terrorist acts, it is vital that the police have a quick and effective way of capturing fleeing suspects, rather than the sometimes suggested alternative of deferring their capture by refusing to engage in the chase.

Police may try to end a car chase quickly by shooting the tires of the fleeing vehicle, but this can be risky and difficult. A hand held, hand aimed firearm, used from a moving car, will be inaccurate. Because the firearm typically is held out a side window of a moving car, the police cannot aim the firearm even by the primitive expedient method of sighting down the barrel. A laser sight could improve this situation slightly, but the police officer still would find the firearm supported by his wavering arm, held out a side window of a bouncing car in the buffeting force of the air from the speed of the car. Clearly, it would be desirable to have a method of shooting out the tires of a fleeing car with improved accuracy, thus more rapidly terminating situations of hot pursuit and restoring safer conditions for the benefit of all concerned, including those involved in the car chase and any bystanders.

In addition, the rights and unknown circumstances of the fleeing suspect should be considered. In the worst case the suspect may be involved in serious crime for which extreme measures are justified. However, in other cases it may be unknown or unclear what a suspect has done or why the suspect is fleeing. Thus, the police may hesitate to fire bullets at each and every fleeing car, as the chances of injuring the fleeing suspect may be inappropriately great. Even carefully shooting at the tires of a fleeing vehicle can endanger the occupants. A sufficiently large bullet can disintegrate a tire, immediately causing the fleeing driver to lose control of his car. It would be impractical for police to carry special ammunition for their side arms, for use only in car chases. Therefore, there is a need for an apparatus associated with police cars, themselves, that can stop a fleeing vehicle with a reasonable opportunity for the fleeing driver to maintain control.

To achieve the foregoing and other objects and in accordance with the purpose of the present invention, as embodied and broadly described herein, the method and apparatus of this invention may comprise the following.

SUMMARY OF INVENTION

Against the described background, it is therefore a general object of the invention to provide an apparatus and method for disabling a pursued land vehicle to end a chase. A related object is to provide a pre-positioned projectile launcher and targeting device, mounted on a pursuit vehicle, to enable a projectile to be fired with reasonable accuracy at a tire of a pursued vehicle.

Another object is provide a protective environment on the pursuit vehicle for the targeting device and projectile launcher so that they are kept reasonably clean and ready for use until they are needed.

The invention provides an apparatus that is suited to disable an inflated tire of a pursued land vehicle. The apparatus includes both a projectile suited for puncturing an inflated tire and a pursuit vehicle that carries and launches the projectile from a position trailing the pursued vehicle. The pursuit vehicle also carries a remote targeting device in a suitable position to identify a target area on an inflated tire of the pursued vehicle. A projectile launcher carries the projectile and launches it when suitably triggered. The launcher is mounted on the pursuit vehicle in a preselected position with respect to the targeting device for launching the projectile at the identified target area. An electrically operated, remote triggering device selectively causes the projectile launcher to launch the projectile at the identified target area, puncturing and thereby disabling the tire of the pursued vehicle.

According to another aspect, the invention provides a method of disabling a pursued land vehicle traveling on an inflated tire along a first path of travel, from a pursuit vehicle traveling along a second path of travel in a relatively trailing position. First, the projectile launcher and targeting device are aligned so that a target area identified by the targeting device is in a mutual proximity to the path of a projectile launched from the projectile launcher. Second, the projectile launcher and targeting device are mounted to a pursuit vehicle in a predetermined position such that the targeting device can identify a target area generally forward of the pursuit vehicle and at a height within a typical tire height above ground level. Third, the pursuit vehicle is positioned with respect to the pursued land vehicle such that the targeting device identifies a target area on an inflated tire of the pursued land vehicle. Fourth, the projectile launcher is actuated to launch a projectile at the target area, thereby puncturing an inflated tire and disabling the pursued land vehicle.

The accompanying drawings, which are incorporated in and form a part of the specification, illustrates preferred embodiments of the present invention, and together with the description, serves to explain the principles of the invention. In the drawings:

DETAILED DESCRIPTION

Figure 1:
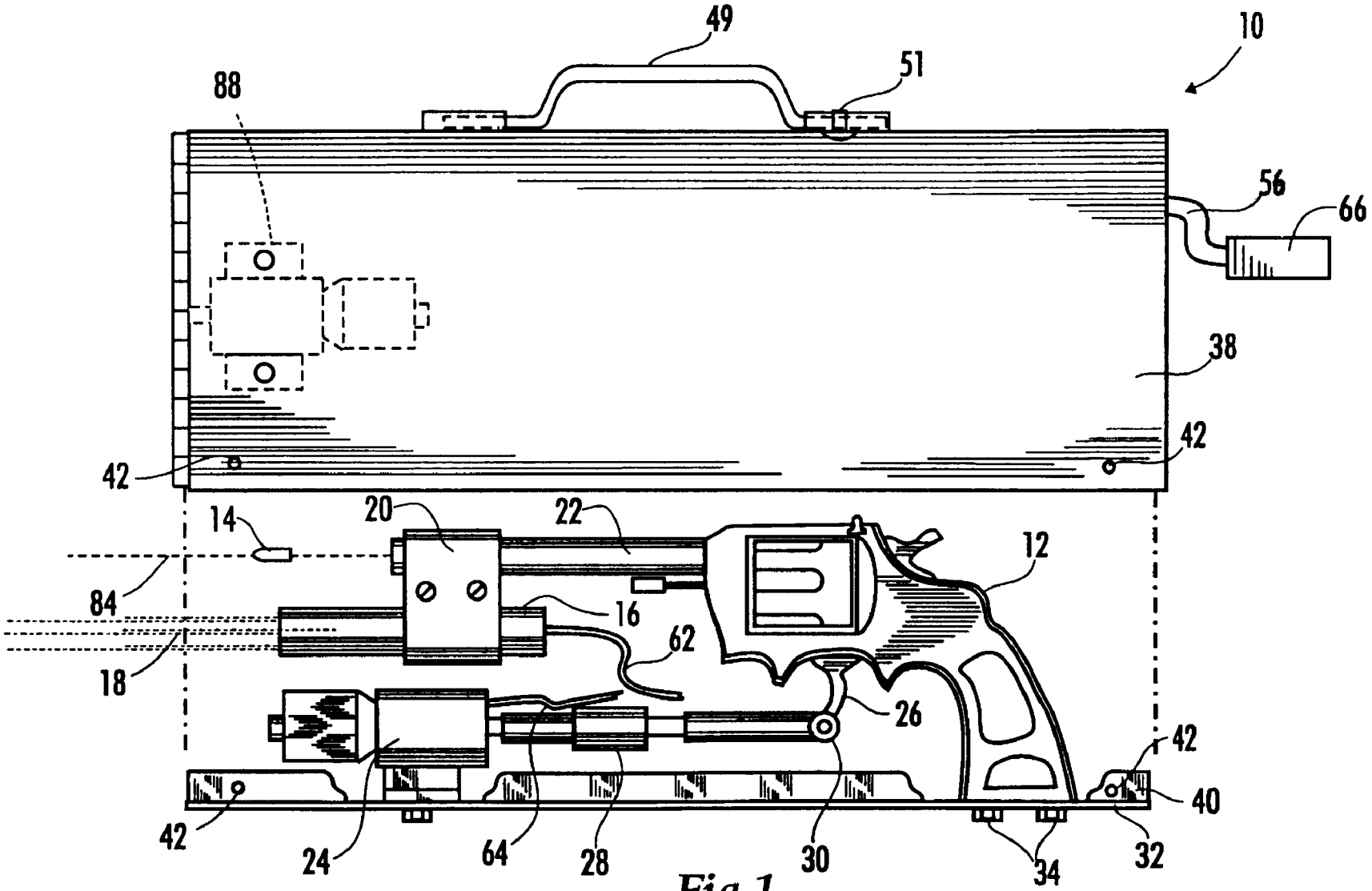
FIG. 1 is an exploded, side elevation view of a secure, remotely actuated projectile launcher, in accordance with the invention.

The invention provides an apparatus and method for disabling a leading land vehicle from a trailing, pursuit land vehicle, using a specially mounted and controlled projectile launcher. For example, the apparatus and method are suited for use by a police car pursuing a fleeing vehicle in a car chase. The projectile launcher is mountable on a pursuit or trailing vehicle and provides an accurate, specially positioned means for launching a disabling projectile at an inflated tire of the fleeing or leading vehicle. The projectile is preselected for an ability to damage the tire to a limited degree, such that the tire is likely to lose inflation in a gradual but prompt manner.

Preferably, the projectile is of a type that tends neither to cause the tire to explode nor to deflate so quickly that the driver of the fleeing vehicle is deprived of any opportunity to bring the vehicle to a controlled stop. Thus, the projectile is designed or chosen such that it is suitable to penetrate only about one wall of a tire at the defined target area. The preferred projectile will not penetrate completely through two walls of a tire. Thus, the projectile is chosen to minimize the possibility of passing beyond the tire and becoming needlessly threatening to occupants of the vehicle and bystanders.

The apparatus can be constructed in any of several configurations to satisfy the needs of the end user, such as a police department or other law enforcement agency. A central component of any configuration is a projectile launcher that is mountable to a vehicle in a substantially fixed and defined position. The projectile launcher is associated with a targeting device for identifying a target area. The launcher and targeting device are mutually positioned so that the targeting device remotely identifies an approximate or likely end point for the flight of the projectile. A remote triggering mechanism causes the projectile to be launched. In addition to these basic components, a security housing may contain the launcher and the targeting device. The triggering mechanism may employ a remote actuator and communication links between the actuator and triggering mechanism. In addition, the triggering mechanism may employ safeguards against accidental launching of the projectile.

The mounting position for the apparatus can be chosen with consideration of the typical tire heights found on a typical mix of passenger vehicles such as cars and light trucks. A typical tire height depends to a degree upon what tires are selected for use on passenger cars and light trucks at a given time. The apparatus is intended to disable substantially any fleeing land vehicle, so the height of the preferred target area should be below the maximum height of almost any tire size for a land vehicle. Commonly, tires have a height less than thirty inches and usually less than twenty-five inches. However, the top portion of a tire on a car or truck may be hidden from the rear or by fender wells, so a preferred target area is at or below about one-half the tire height. Considerations of public safety also favor a low target area, so that a missed shot strikes the ground as promptly as feasible. A preferred target area is in the lower half of a tire, below fifteen inches of ground level. The most visible portion of a tire inevitably is the bottom portion, where the height of rubber between the ground and the tire rim often less than four inches. Therefore, the most preferred target area is within four inches of ground.

The position of the projectile launcher and targeting device on the trailing vehicle is preferred to be low, so that the projectile launcher will fire forward without a substantial upward trajectory. For example, if a laser sighting device is used with the projectile launcher, it would be preferred for safety that the laser beam be adjusted to sight along parallel-to-ground sight line or a declining sight line, when the pursuit vehicle is on a level surface. This alignment will be referred to as a flat line of fire, although the actual projectile may have a slight upward component in its trajectory to compensate for gravity. A low mounting results in the tires on a fleeing vehicle being well exposed for targeting and firing the projectile with a flat line of fire.

A low position enables the projectile launcher to fire a flatly aimed shot that will be able to strike a tire regardless of whether the distance of the shot is the preferred target distance. However, the projectile launcher and targeting device should be mounted high enough that they have adequate ground clearance for avoiding accidental contact with the ground or with low obstacles in a roadway. For this reason, it will be generally impractical to mount the projectile launcher or targeting device as low as four inches from the ground. A higher mounting, such as eight to twelve inches from the ground is preferred, which will allow the projectile to have a flat trajectory.

A guideline for selecting both the mounting height and position on the trailing vehicle is the height of the front bumper or front faring. A preferred mounting position is below or within the front bumper. At least some car designs employ a beam as the front bumper. The front of a car often carries a facade or faring that extends below the bumper beam and often hides the actual beam. The lower edge of a faring also provides a safe guideline for a suitable distance above ground level for avoiding road damage. The projectile launcher and targeting device often can be bolted to the bottom of a front bumper beam as a secure mounting point. The apparatus may reside in a safe zone between the bottom of the beam and the lower edge of the faring.

The apparatus is intended for use primarily on passenger cars, such as police cars. The apparatus is intended to be used from a trailing position, such that it operates primarily in a forward direction, from the perspective of a car having a longitudinal forward end and traveling in a longitudinal or forward direction. A laterally acute mounting angle, relative to the direction of vehicle travel, provides protection against road debris, rain, or snow entering the security housing and damaging the projectile launcher or targeting device. The security housing provides a projectile opening in its front wall through which a projectile is launched. The targeting device also may operate through the same opening or a separate targeting opening. The front wall of the security device can shield against direct impacts from rain, snow, or debris through these openings when the security housing is angled sufficiently from the centerline of the trailing vehicle. As additional, long term defense against damage, the security housing may carry a deflector at the leading side of the openings.

As a substitute or supplemental defense, the security housing may cover the openings with a remotely openable shield door. Thus, over periods when this apparatus is not needed, the shield door will remain keep the interior of the security housing in a clean condition. During use, both the targeting device and the projectile launcher still benefit from the angled mounting to obtain protection from direct impacts.

In addition to the security housing being mounted low on the vehicle and at a lateral angle, the security housing benefits from being mounted near a lateral side of the vehicle. A preferred position is near the lateral side opposite from the driver's position. A mounting near the right edge of the vehicle is preferred.

A related method is directed to disabling a relatively leading land vehicle from a relatively trailing land vehicle. The method employs an initial step of establishing a predetermined, mutually aligned relationship between a projectile launcher and targeting device. A target area identified by the targeting device and the path of a projectile launched from the projectile launcher should be established to be in a predefined mutual proximity at a point remote from the projectile launcher. For example, at a predetermined distance from the projectile launcher, which will be referred to as a preferred target distance, the path of the projectile and the target area should substantially coincide.

In a second step, the projectile launcher and targeting device are mounted to a land vehicle, which for convenience of identification will be referred to as a trailing land vehicle. Such a vehicle typically may be a police car. The launcher and targeting device are mounted in a predetermined position with respect to the trailing land vehicle, such that the targeting device can identify a target area generally forward of the trailing land vehicle. Further, the mounting position of the projectile launcher should locate a preferred target area, at the preferred target distance, within a typical tire height above ground level, as explained previously. The mounting position may incorporate the described considerations for an acute lateral angle and a generally horizontal or downward forward targeting line of sight.

During a pursuit of a leading, fleeing land vehicle, the trailing land vehicle is positioned as necessary to enable the targeting device to identify a target area in proximity to a tire of the leading land vehicle. If the security housing is positioned with a lateral angle, to either the left or right, the trailing vehicle may be positioned suitably to enable targeting a tire on the leading vehicle.

Either prior or subsequent to positioning the trailing vehicle, the targeting device is actuated. With a suitable targeting device, the trailing vehicle can be better positioned to identify a target area on a tire of the leading vehicle. A laser sighting device is suitable for targeting purposes.

When a target area is identified, the projectile launcher is actuated to launch a projectile at the target area, to strike a tire and thereby disable the leading vehicle. The driver of the trailing vehicle can monitor a laser sight for as long as necessary to ensure a reliable shot. For example, the driver can await a level stretch of road or adjust the trailing distance. The occupants of the leading vehicle are unlikely to know the laser sight is in operation. Hence, there would be little motivation to take continuous evasive action against such sighting.

Prior to or simultaneously with actuating the sighting device, any protective shield or door for the targeting device or projectile launcher may be opened or withdrawn. An automated system may withdraw such a shield simultaneously with the actuation of the targeting device and may restore the shield with the deactivation of the targeting device. With reference to the drawings, the apparatus 10 includes a suitable projectile launcher such as a firearm that is capable of launching a bullet. The drawings show a six-shot pistol 12, which is readily adapted for this purpose.

A suitable firearm fires a projectile such as a bullet or slug 14. A twenty-two caliber bullet or smaller has been found to be highly appropriate, as having the capability to penetrate a tire and flatten it without causing excessive damage. While a twenty-two caliber bullet is preferred, the bullet may be larger. Preferably the bullet is no larger than thirty-eight caliber. Another measure of suitable projectiles is the muzzle velocity of a bullet, which is a product of slug size, powder charge, and other characteristics. A suitable bullet should have a muzzle velocity no greater than 1,400 feet per second.

FIG. 1 shows a bullet 14 launched from the pistol and following a flat path suggested by the broken line aligned with the illustrated bullet. The targeting device may be a laser sighting device 16 that can be actuated to project a laser beam 18. A clamp or mount 20 adjustably connects the pistol 12 and laser sighting device 16 so that the laser beam 18 can serve as a sighting device for the pistol. The field of broken lines 18 is suggestive of a laser beam following a path approximately parallel to the suggested trajectory of bullet 14.

The laser sighting device 16 is mounted closely adjacent to the pistol barrel 22, such as within an inch or two of the barrel, and below the barrel for compactness. Thus, the laser beam 18 projects approximately parallel to the barrel 22 and identifies an approximate end point for the path of a bullet slug 14 fired through the barrel. As with known sighting devices, fine adjustments can bring the laser beam 18 into intersection with the path of a bullet at a preselected distance. Further, since the trajectory of a bullet is subject to dropping under force of gravity, while a laser beam is not, the trajectory of a bullet may cross the path of the laser beam at a predetermined distance even if both trajectories initially are parallel. Therefore, it is useful to note that the preferred target distance is in the approximate range from thirty to fifty feet, over which the drop in the trajectory of a twenty-two caliber bullet is negligible. According to a preferred adjustment, the laser beam can be fixed to be approximately parallel or converging with the path of the bullet at a range of about fifty feet.

A remotely controlled triggering mechanism for the pistol 12 may be formed of a push solenoid 24 that is connected to the trigger 26 of the pistol from the front of the pistol. An intermediate linkage may include a flex joint 28 that accommodates the arc of trigger movement, and this linkage may be joined to the trigger by a pivot 30. The solenoid 24 and pistol 12 are held at a fixed distance to that the linkage will force the pistol to fire when the solenoid is actuated.

Both the pistol 12 and the solenoid 24 may be mounted to a common base plate 32. For example, both are attached to the base plate by bolts 34. As an alternative, the solenoid could be attached to the pistol by a direct mounting. However, base plate 32 is preferred because it provides a convenient common support for both the pistol 12 and the solenoid 24. In addition, the base plate 32 serves as a portion of a security housing 36, FIG. 3, that includes a cover 38. A raised edge or flange 40 on the base plate stiffens the base plate and also provides an overlapping wall that is engaged within the cover 38. Removable fasteners may secure the base and cover together using mating fastening apertures 42 shown in FIG. 1.

Figure 5:
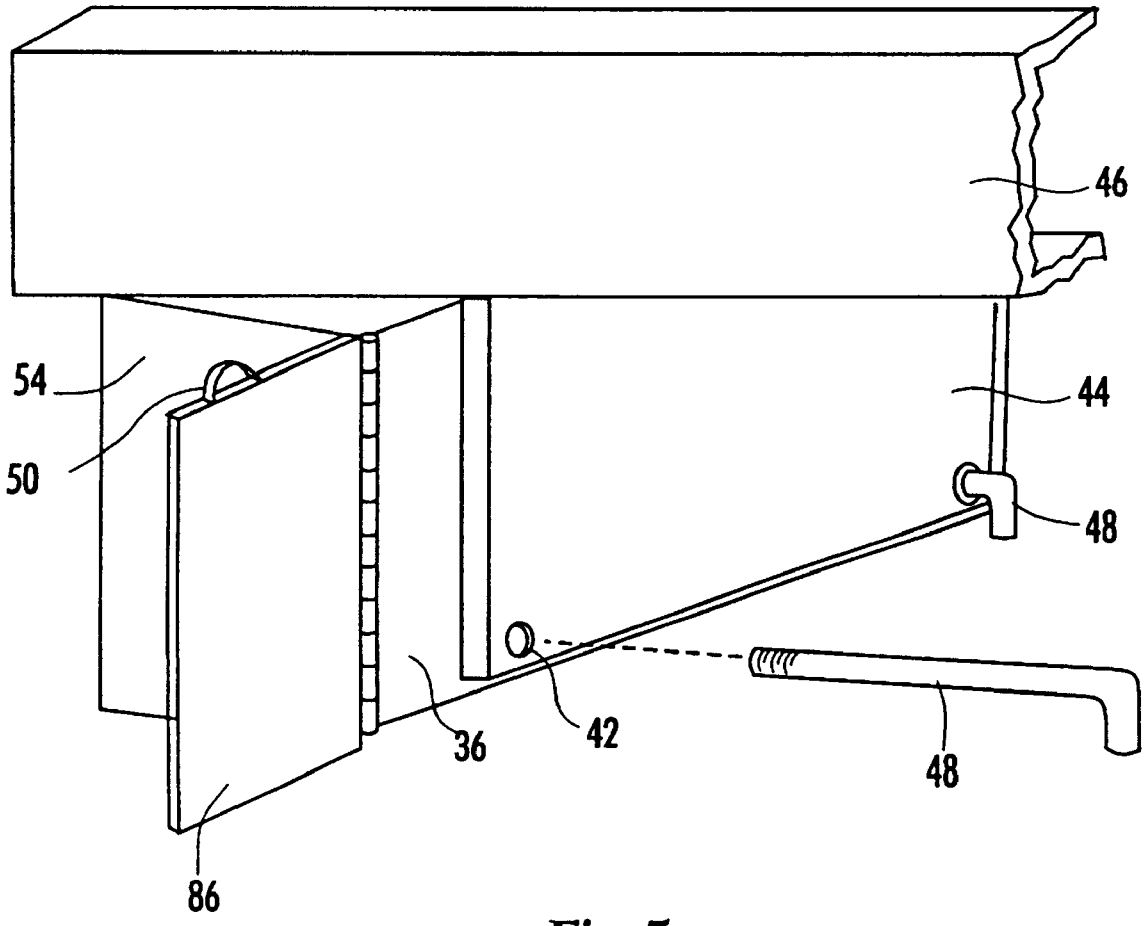
FIG. 5 is a front isometric view of the security housing and a protective shield door, mounted below a vehicle bumper beam, also showing an angled mounting of the security housing with respect to the vehicle's direction of forward travel.

As suggested in FIG. 5, these fastening apertures 42, or other similar apertures, also can provide a secure mounting to the vehicle. For example, side brackets 44 may be welded to the vehicle bumper 46 to define a slot for receiving the security housing, which can be secured into the slot by sliding transverse mounting rods 48 through the apertures 42 and through the brackets 44 on the bumper. A rod 48 can be secured by a threaded end or locked at a protruding end with a padlock to prevent unauthorized removal of the housing 36. Other suitable mounting means for the security housing may include a clip or bracket 49, FIG. 1, that is mounted to the frame or bumper of a vehicle and releasably engages the security housing, such as by a securing screw 51.

Figure 2:
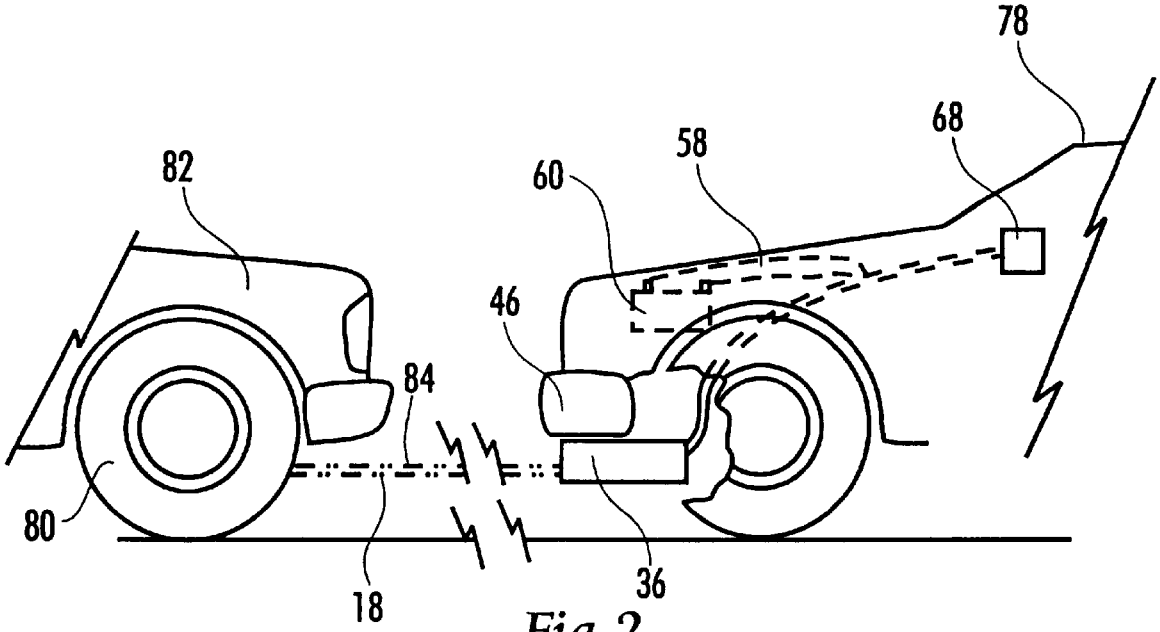
FIG. 2 is a schematic side elevation view of the apparatus and method of the invention applied between a fleeing car and a pursuit car.
Figure 3:
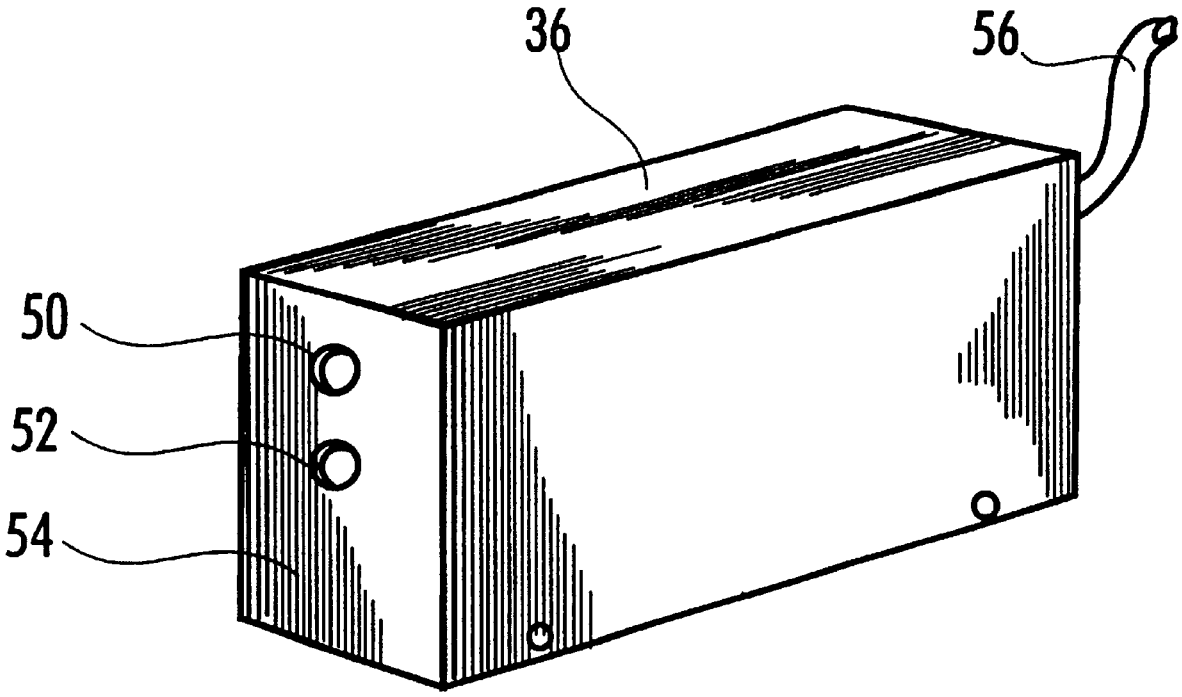
FIG. 3 is an isometric view of a security housing for the remotely actuated projectile launcher of the invention.

With reference to FIG. 3, security housing 36 defines a projectile opening 50 and a targeting opening 52 in the front wall 54 of the housing. A control harness 56 extends from the rear wall of the security housing and is routed to controls within the cab of the trailing vehicle. Cable 56 includes all necessary wires for operating the laser, the solenoid, and any additional powered equipment for the apparatus 10. A suggested wiring harness is shown in FIG. 2 to include electric power leads 58 to the vehicle battery 60.

The laser sight 16 and solenoid 24 are selected to operate from a suitable electric power source, such as a twelve volt car battery 60. The laser sight 16 is powered through a suitable electric cable 62, while the solenoid is powered through a cable 64, both shown in FIG. 1. These cables are included within harness 56. For convenience in installing or removing the security housing from a vehicle, cable 56 may be provided with one or more connecting plugs 66. For example, a plug 66 is conveniently located near the rear wall of the security housing so that the housing can be readily separated from the vehicle for maintenance.

Figure 4:
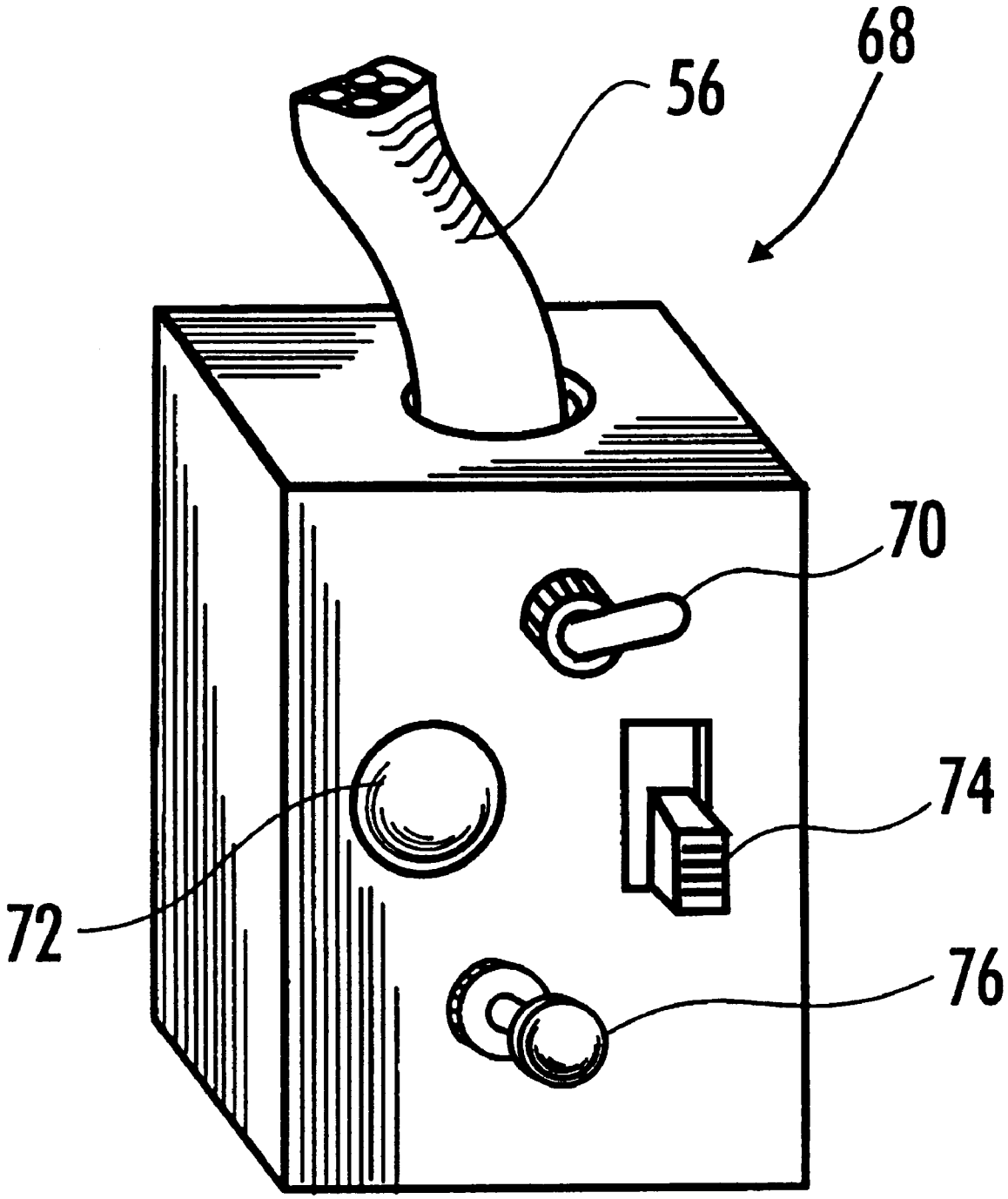
FIG. 4 is an isometric view of an actuator for the remotely actuated projectile launcher.

In addition to the solenoid 24, the triggering mechanism may employ remote actuator assembly 68, FIGS. 2 and 4. The harness 56 serves as a communication link between the actuator 68 and the solenoid. The actuator may be a modular control panel or box as illustrated, or the controls may be directly incorporated into a dashboard.

Recommended controls include a power activation switch or arming switch 70 with an associated alert light 72. The arming switch controls current from battery 60 to a firing button 76. Switch 70 is a two-position, on-off switch. Light 72 is wired in parallel to the switch and is lit as a visual reminder that switch 70 is in "on" position and switch 76 is armed to fire the projectile. Additional alert features, such as a flashing feature on the light or an audio tone, are optional. A springloaded firing plunger switch 76 is active to receive current at least when power switch 70 is "on." A two-position targeting slide switch 74 is active to transmit current to laser 16 regardless of whether arming switch 70 is "on." The targeting switch 74 is an on-off switch. When in "on" position, the switch directs current through cable 62 to the laser sighting device 16. The laser sighting device can be used without arming the firing button, which allows the laser sighting device to be safely used for practice or trial sightings.

The security housing 36 can be mounted to a vehicle, such as trailing vehicle 78, FIG. 2, to any portion of the vehicle. A recommended mounting position is on the lower side of the front bumper 46, at an acute lateral angle in the approximate range from ten to twenty degrees, and aimed with a substantially flat elevation. The housing may be secured to the vehicle 78 by bolts, brackets, or straps engaging the security housing. As shown in FIG. 5, mounting rods 48 through apertures 42 near the opposite ends of the housing provide a stable mounting. The mounting height of the pistol 12 should be at approximately a suitable height for shooting a flat shot at tire 80 of a leading vehicle 82, FIG. 2, as suggested by the phantom lines showing laser beam 18 and projectile path 84. The closure member is useful for protecting the contents of the security housing from road debris, weather, or other sources of abrasion and damage. A deflector door and protective shield 86 may cover the front wall 54 of the security housing when the apparatus is not in use. The shield can be withdrawn or opened when the apparatus is in use. In the withdrawn or opened position shown in FIG. 5, the shield extends from or near the leading edge of the openings 50, 52, to protect against entry of debris. A suitable shield 86 may cover part or all of the front wall 54. The shield is hinged or pivoted at a side of the openings 50, 52, corresponding to the intended leading edge, such as the left edge when the security housing is angled to the right of the vehicle 78.

A door solenoid 88, shown in phantom as within the cover 38 in FIG. 1, can be triggered to open the door in response to power switch 70 or 74 being switched on. When opened, the shield may be limited in its degree of opening by the maximum extension of the solenoid 88 so that it clears a functional path through the openings 50, 52. The partially open door 86 continues to serve as an aerodynamic deflector that partially protects the openings from debris. The solenoid 88 may be spring-biased to closed position so that the shield door closes when power switch 70 and 74 are switched off.

Figure 6:
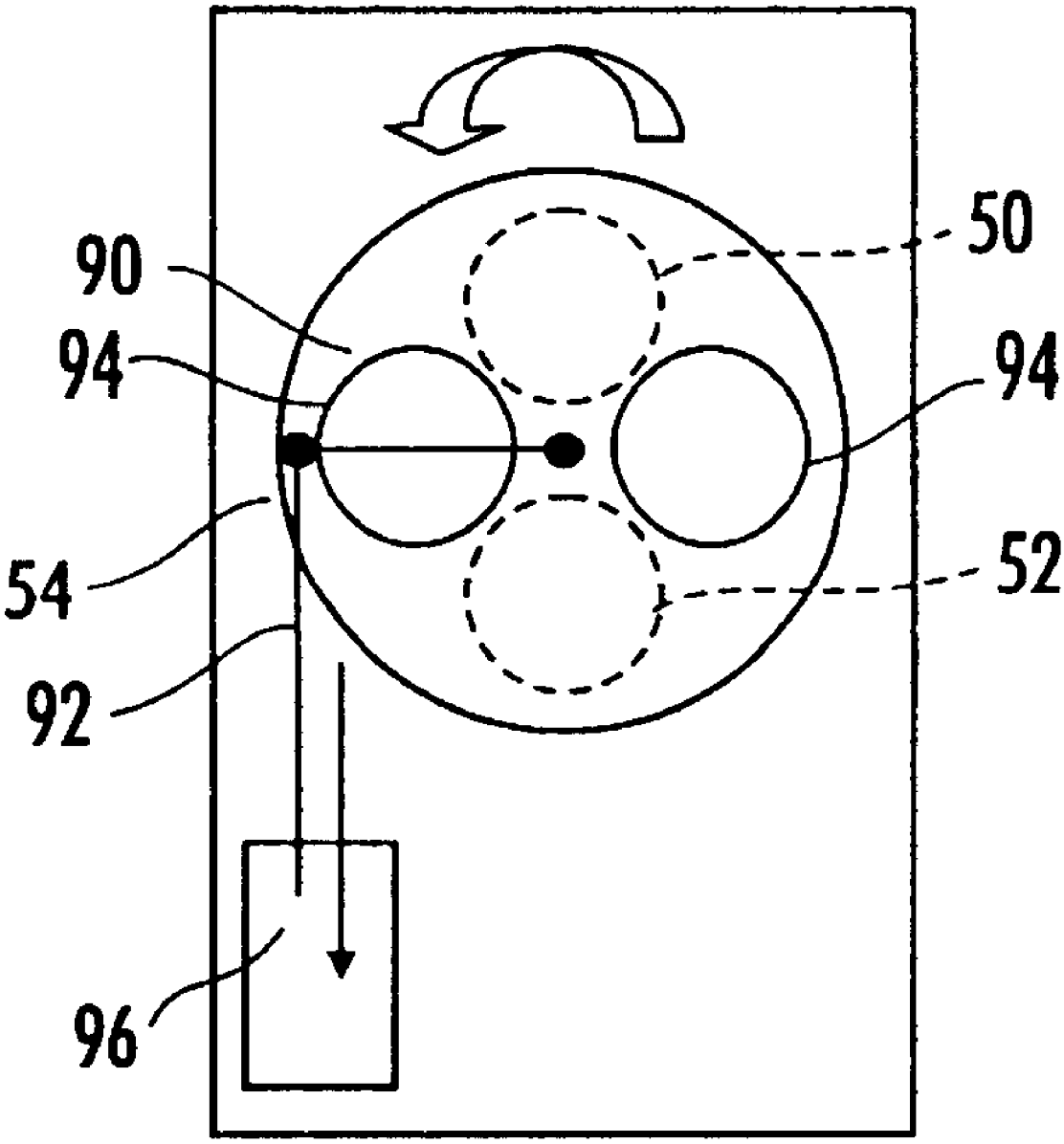
FIG. 6 is an elevation view of the front wall of the security housing, showing an alternate embodiment of the protective door and a schematic view of an opening actuator.

An alternative protective door 90, FIG. 6, is a rotating panel operating parallel to the front wall 54 of the security housing. Operating linkage 92, which may be a solenoid linkage arm and pivot rod, turns the rotary panel on a center pivot to align openings 94 with the projectile opening 50 and targeting opening 52 in the security housing. A pull solenoid actuator 96 selectively opens and closes door 90.

Figure 7:
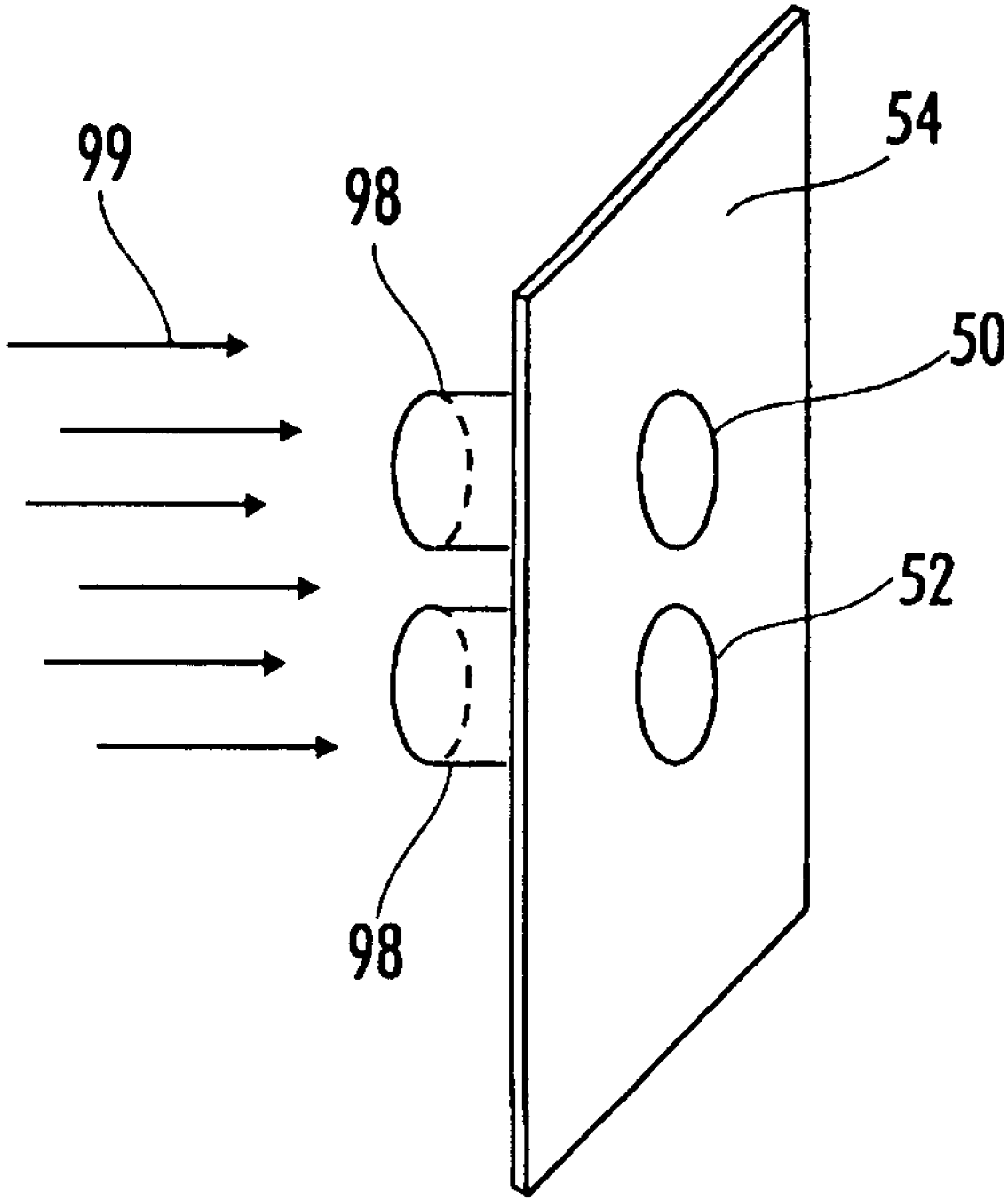
FIG. 7 is a fragmentary isometric view taken from the inside face of the front wall of the security housing, showing another embodiment of a protective shield.

FIG. 7 shows another type of closure member or protective shield. One or more elongated tubes 98 are joined to the front wall 54 of the security housing at projectile opening 50 and targeting opening 52. The tubes may extend forward from the front wall in an approximately perpendicular relationship. The tubes are aligned for allowing passage of the laser beam 18 and the projectile 14. As suggested by the array of arrows 99 representing any type of road debris or other foreign matter, the security housing can be expected to encounter such foreign matter as it travels in the vehicle's direction of forward motion. Because the security housing is mounted at a lateral angle with respect to the vehicle's typical direction of forward motion, foreign matter entering the open forward end of a tube 98 often will strike a tube wall before completing passage through a tube 98. Thus, the tubes may deflect foreign matter from striking the laser 16 or entering barrel 22.

Figure 8:
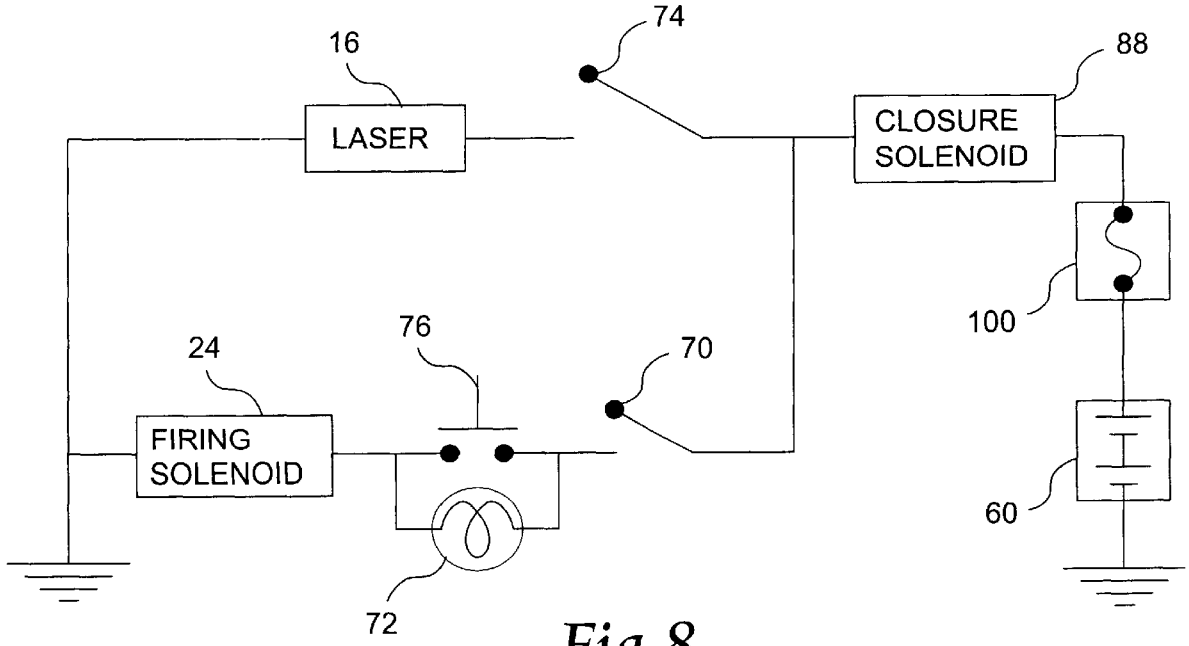
FIG. 8 is a schematic diagram of a wiring system for operating the sighting and firing mechanisms.

FIG. 8 shows a suggested wiring diagram for the firing and sighting system. Battery 60 is connected through a fuse 100 to a sighting circuit branch and a firing circuit branch. The sighting circuit branch includes switch 74 and laser 16. The firing circuit includes arming switch 70, firing switch 76 with light 72 in parallel, and firing solenoid 24.

If a closure panel or protective shield is used to cover the firing and targeting openings in the security housing, an operating device such as a solenoid 88 is connected to the wiring harness to open the closure to permit operation of the laser sighting device and projectile launcher. Solenoid 88 can be connected between battery 60 and either circuit branch to open the closure whenever either laser 16 is actuated or switch 76 is armed. Solenoid 88 is shown in FIG. 8 as a circuit element in series with both the sighting and arming switches. To ensure that the solenoid 88 has opened the necessary openings before the projectile is launched, the circuit elements could be modified to provide a feedback signal confirming the opening of the closure panel. For example, the closure panel can strike a micro switch when fully open, sending a signal to solenoid 88 allowing current to pass to switch 70. Alternatively, solenoid 88 may include a delay circuit, allowing a timed interval for the closure panel to open before current can pass to switch 70. These and other modifications to the wiring system of FIG. 8 are within the contemplated scope of the invention.

The firearm of apparatus 10 is shown and described as a conventional pistol. Other components of the apparatus are selected from commercially available devices. These components were selected to illustrate a readily assembled, present best-mode of the apparatus. Because such devices as a pistol are designed for hand held use, other, custom designed components may be more desirable and more efficient in this apparatus. For example, the handle of a pistol could be replaced by more compact mounting brackets. The trigger and hammer of a pistol could be replaced by an electronic firing system, in which a firing solenoid directly thrusts a firing pin against a bullet cartridge. Thus, the apparatus could be made much more compact than illustrated, such as with the barrel 22 in line with a firing solenoid and contained in a narrow housing or tube of less than one-half the height suggested by the drawings.

The forgoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

What is claimed is:

1. Apparatus for disabling an inflated tire of a land vehicle having an inflated tire and moving on a first path of travel, comprising:

a projectile suited for puncturing said inflated tire;

a pursuit vehicle trailing the land vehicle while moving along a second path of travel that is generally parallel to the first path of travel;

a remote targeting device mounted on said pursuit vehicle and identifying a target area on said inflated tire of the land vehicle;

a selectively and remotely actuated projectile launcher carrying said projectile and capable of launching it when suitably triggered, mounted on the pursuit vehicle in a preselected position with respect to said targeting device for launching said projectile at the identified target area; and an electrically operated, remote triggering device for selectively causing said projectile launcher to launch the projectile at the identified target area, puncturing and thereby disabling the tire of the land vehicle.

2. The apparatus of claim 1, wherein said projectile comprises a bullet no larger than thirty-eight caliber.

3. The apparatus of claim 1, wherein said projectile is a bullet of firing velocity no greater than 1,400 feet per second.

4. The apparatus of claim 1, wherein said electrically operated, remote triggering device comprises:

an electric power source;

an indicator responsive to receiving electric power for showing that the triggering device is in an active state;

a targeting actuator responsive to receiving electric power for selectively actuating said targeting device;

a launching actuator responsive to receiving electric power for selectively actuating said projectile launcher; and a power switch connected to said electric power source for selectively connecting electrical power to the indicator, targeting actuator, and launching actuator.

5. The apparatus of claim 1, further comprising:

a housing connected to said pursuit vehicle, containing said targeting device and projectile launcher, and providing at least one opening through which the targeting device and projectile launcher are operable, respectively, to identify a target area and launch a said projectile at the identified target area.

6. The apparatus of claim 1, wherein:

said projectile launcher is mounted on the pursuit vehicle in a preselected position with respect to the second path of travel for launching said projectile at an acute lateral angle to the second path of travel, whereby the projectile may be launched at said inflated tire of the land vehicle with the second path of travel offset transversely from the first path of travel.

7. The apparatus of claim 1, further comprising:

a housing containing said projectile launcher and mounted to said pursuit vehicle in a position aiming said projectile launcher at an acute lateral angle relative to said second path of travel;

wherein the housing defines a projectile passage suitably positioned to allow passage of said projectile launched from said projectile launcher; and the housing further comprises a closure member selectively moveable between a closed position covering the projectile passage and an open position uncovering the projectile passage.

8. The apparatus of claim 7, wherein said closure member is joined to said housing near a leading edge of the projectile passage, relative to the second path of travel, such that when the closure member is in open position, the closure member at least partially shields the projectile passage in the second path of travel.

9. The apparatus of claim 1, further comprising a housing containing said projectile launcher and mounted to said pursuit vehicle in a position offset from the center of the pursuit vehicle to a lateral side thereof.

10. The apparatus of claim 1, wherein said pursuit vehicle defines a driver's side offset to one side of center, and further comprising a housing containing said projectile launcher and mounted to said pursuit vehicle in a position offset from the center of the pursuit vehicle to a lateral side opposite from the driver's side.

11. A method of disabling a pursued land vehicle traveling on an inflated tire along a first path of travel, from a pursuit vehicle traveling along a second path of travel in a relatively trailing position, comprising:

first, establishing a predetermined mutually aligned relationship between a projectile launcher and a targeting device, such that a target area identified by the targeting device and the path of a projectile launched from said projectile launcher are in a predefined mutual proximity at a point remote from the projectile launcher by a predetermined distance;

second, mounting the projectile launcher and targeting device to a pursuit vehicle in a predetermined position with respect to the pursuit vehicle, such that the targeting device can identify a target area generally forward of the pursuit vehicle and at a height within a typical tire height above ground level;

third, positioning the pursuit vehicle with respect to the pursued land vehicle such that the targeting device identifies a target area on said inflated tire of the pursued land vehicle; and fourth, actuating the projectile launcher to launch said projectile at the target area to puncture said inflated tire and thereby disable the pursued land vehicle.

12. The method of claim 11, wherein the projectile is a bullet no larger than thirty-eight caliber.

13. The method of claim 11, wherein the projectile is a bullet no larger than twenty-two caliber.

14. The method of claim 11, wherein said second step of mounting the projectile launcher and targeting device to a pursuit vehicle further comprises:

locating the projectile launcher and targeting device within a housing that provides at least one opening through which the targeting device and projectile launcher are operable, respectively, to identify said target area forward of the pursuit vehicle and launch said projectile at the identified target area; and mounting the housing to the pursuit vehicle in a preselected position for launching the projectile at an acute lateral angle to the second path of travel, whereby the projectile may be launched at said inflated tire of said pursued land vehicle with the second path of travel of the pursuit vehicle offset transversely from the first path of travel of the pursued land vehicle.

15. The method of claim 14, further comprising:

providing a closure member on the housing, selectively moveable between a closed position covering the projectile passage and an open position uncovering the projectile passage.

16. The method of claim 15, further comprising:

prior to said step of actuating the projectile launcher to launch said projectile, opening said closure member; and launching the projectile through the projectile passage.

* * * * *